United States Patent [19]

Gutierrez

[11] 4,185,423

[45] Jan. 29, 1980

[54] LIGHTWEIGHT BUILDING MODULE

[75] Inventor: Enrique H. Gutierrez, San Juan, P.R.

[73] Assignee: Systems Concept, Inc., Miami, Fla.

[21] Appl. No.: 890,247

[22] Filed: Mar. 27, 1978

[51] Int. Cl.[2] ..... E04B 1/34

[52] U.S. Cl. ..... 52/79.9; 52/251; 52/422; 52/602; 52/745

[58] Field of Search ..... 52/79.1, 79.9, 79.11, 52/79.14, 79.13, 745, 340, 250, 251, 258, 383, 431, 600, 602, 422

[56] References Cited

U.S. PATENT DOCUMENTS

| | | | |
|---|---|---|---|
| 1,640,065 | 8/1927 | Blaw . | |
| 1,959,119 | 5/1934 | Young . | |
| 2,053,873 | 9/1936 | Niederhofer . | |
| 2,108,065 | 2/1938 | Kotrbaty . | |
| 2,145,496 | 1/1939 | Reinhard . | |
| 2,558,946 | 7/1951 | Fromson . | |
| 2,703,003 | 3/1955 | Ruppel . | |
| 3,331,170 | 7/1967 | Lowe et al.. | |
| 3,468,081 | 9/1969 | Saarinen . | |
| 3,514,910 | 6/1970 | Comm . | |
| 3,564,795 | 2/1971 | Henton . | |
| 3,714,304 | 1/1973 | Carner et al.. | |
| 3,750,366 | 8/1973 | Rich et al.. | |
| 3,763,613 | 10/1973 | Wise . | |
| 3,990,193 | 11/1976 | Ray et al. | 52/745 X |

FOREIGN PATENT DOCUMENTS

| | | |
|---|---|---|
| 263300 | 7/1968 | Austria . |
| 2014558 | 10/1970 | Fed. Rep. of Germany . |
| 1126780 | 5/1963 | United Kingdom . |
| 1209160 | 9/1968 | United Kingdom . |

*Primary Examiner*—J. Karl Bell
*Attorney, Agent, or Firm*—Kenyon & Kenyon

[57] ABSTRACT

Design, fabrication and erection of a lightweight building module in the form of a ribbed concrete floor slab with lightweight thin concrete wall panels and ceiling panel reinforced by a series of spaced rigid annular open web frames. Each frame includes a floor reinforcing member, two side wall reinforcing member, and a ceiling reinforcing member, rigidly welded together at their adjacent ends. Each reinforcing member is an open web joist having two parallel straight rods spaced apart by an open web member formed by bending a rod in a zig-zag pattern. Longitudinal spacing of adjacent bends is greater in the central portion than the ends of the reinforcing members. A poured concrete roof slab is formed with integral reinforcing ribs by means of rectangular spacers made of light weight material. The modules may be installed at a building site by distributing a layer of thin mortar over compacted earth and placing each module thereon before the mortar hardens, so that the weight of the module is evenly distributed by the mortar pad. A cross-bracing feature for multiple story buildings improves the strength, rigidity and stability of the total structure.

18 Claims, 40 Drawing Figures

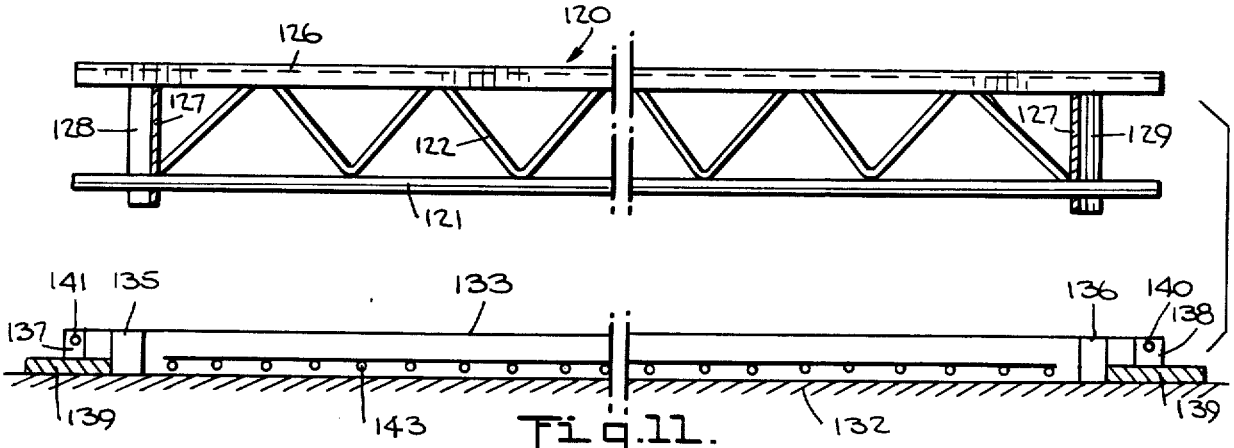
Fig. 11.
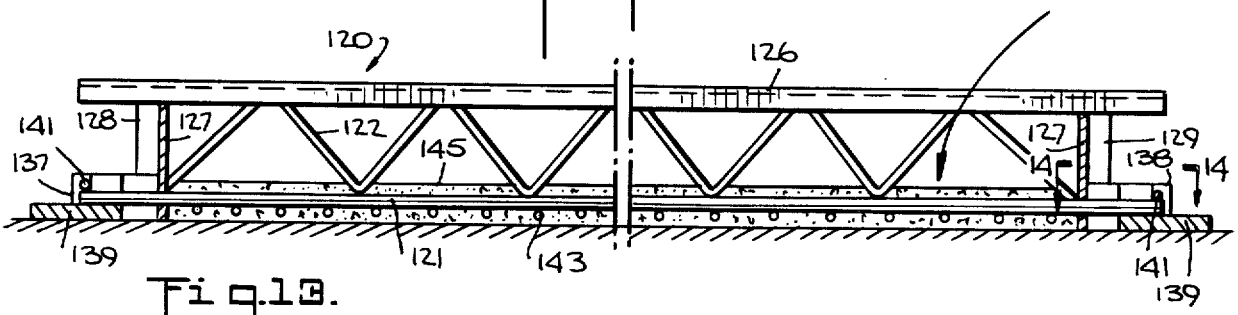
Fig. 13.
Fig. 15.
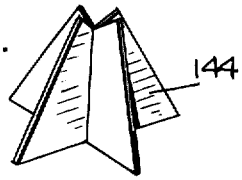
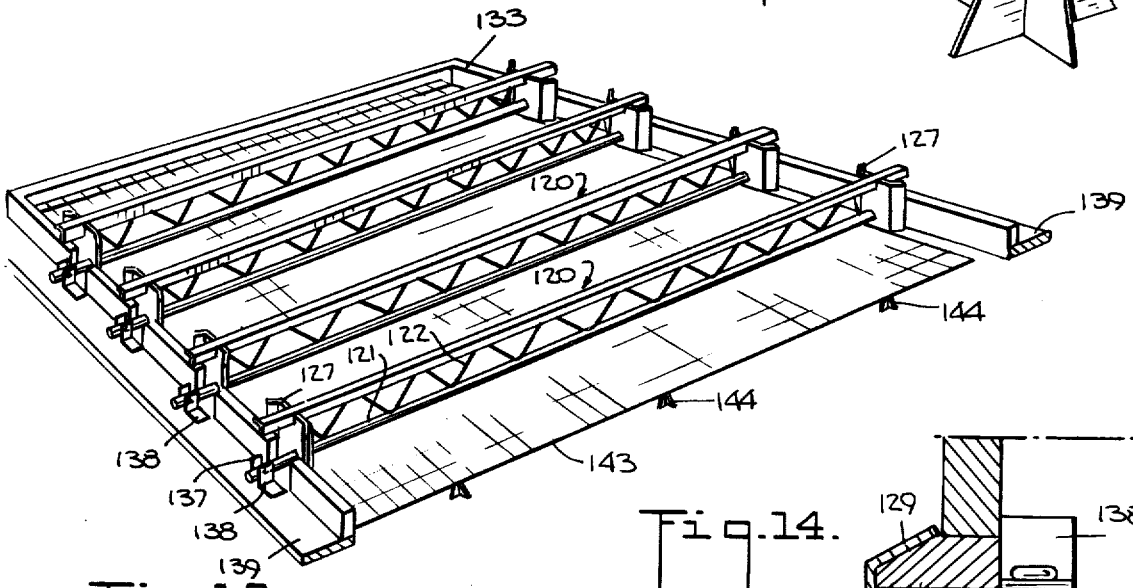
Fig. 12.
Fig. 14.
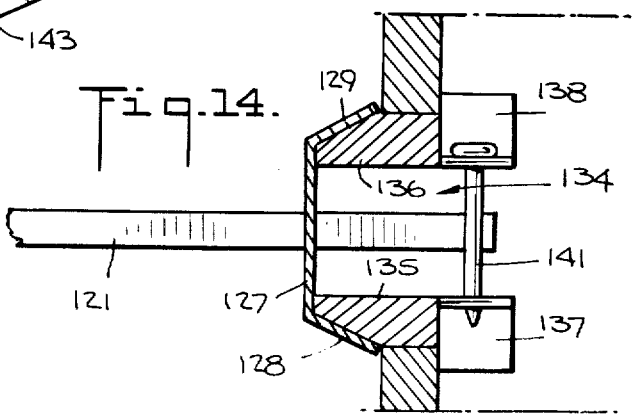

Fig. 16.
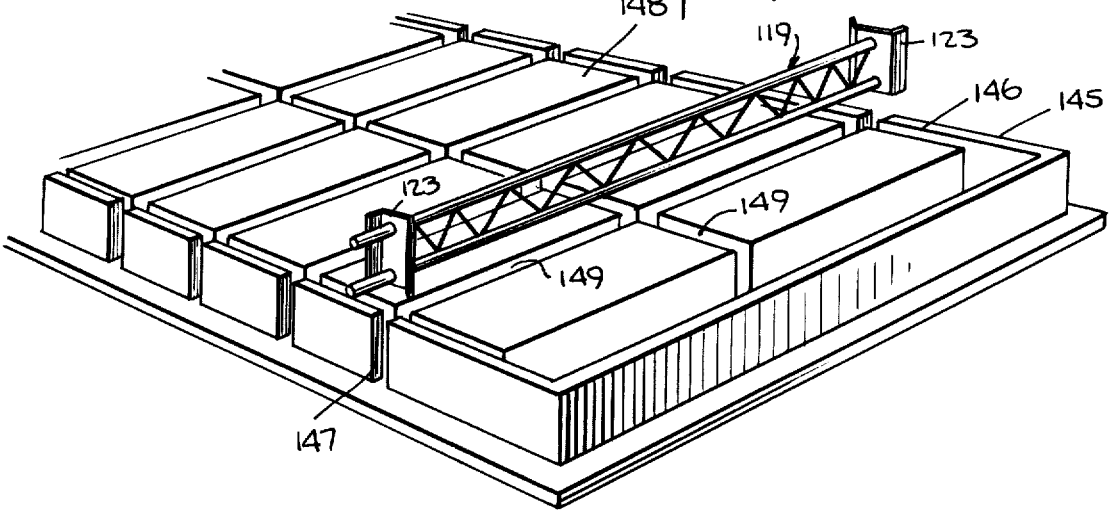
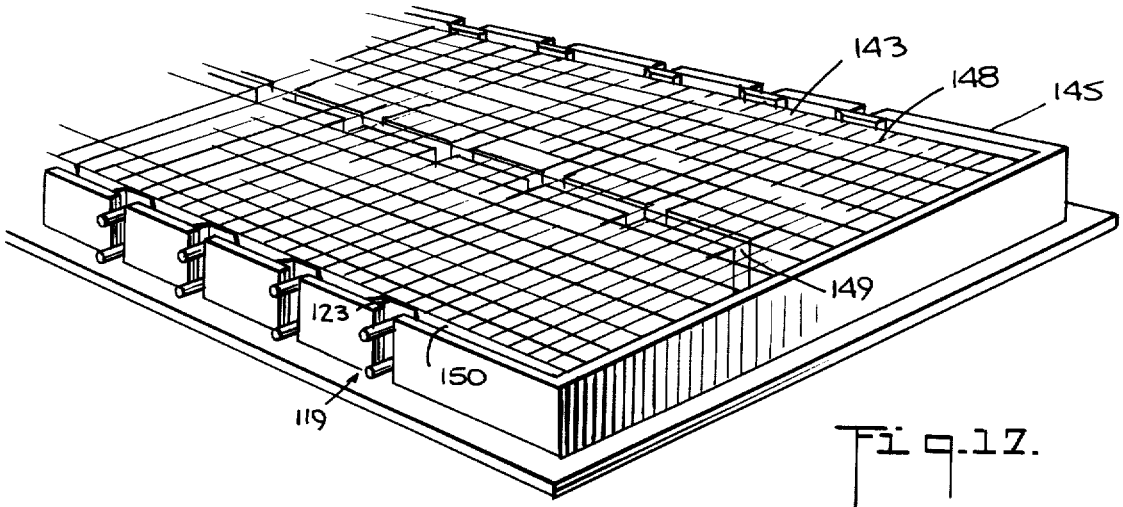
Fig. 17.
Fig. 18.
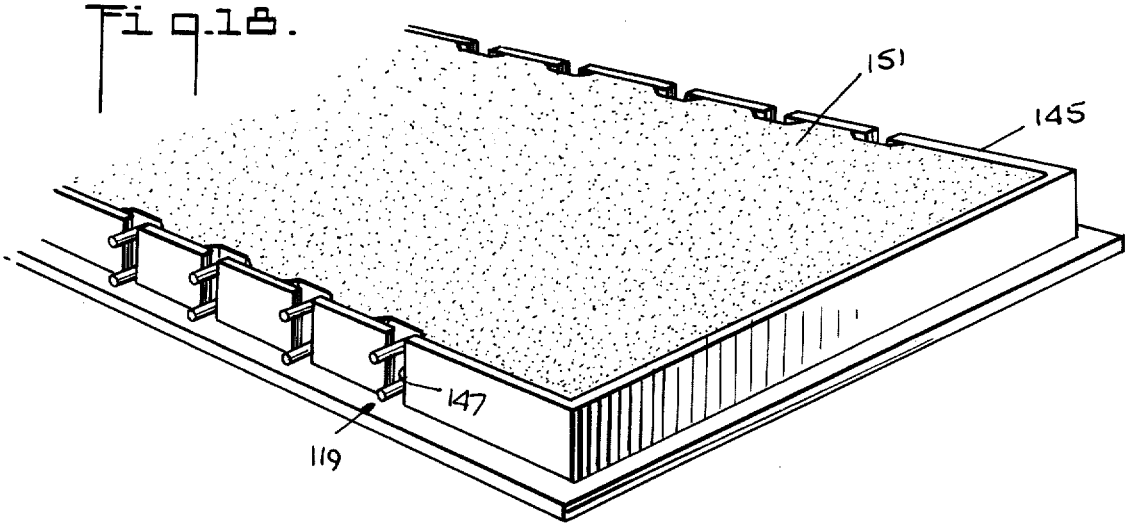

Fig. 19.
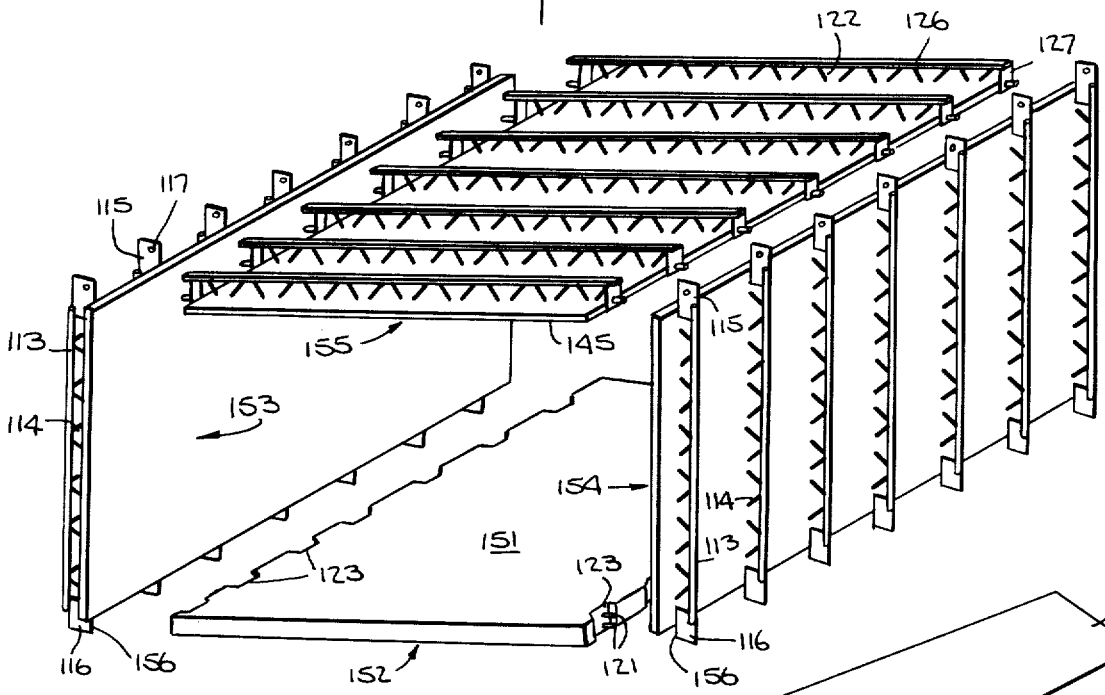
Fig. 17.
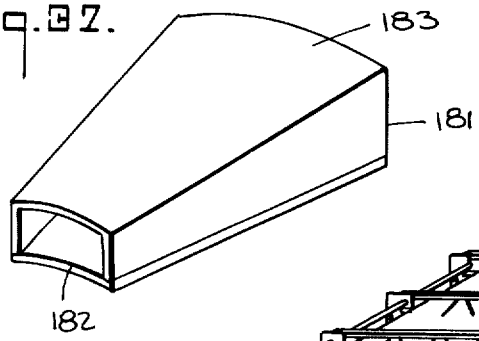
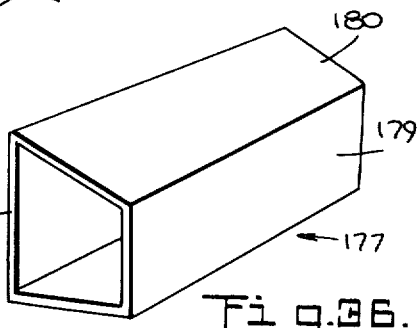
Fig. 16.
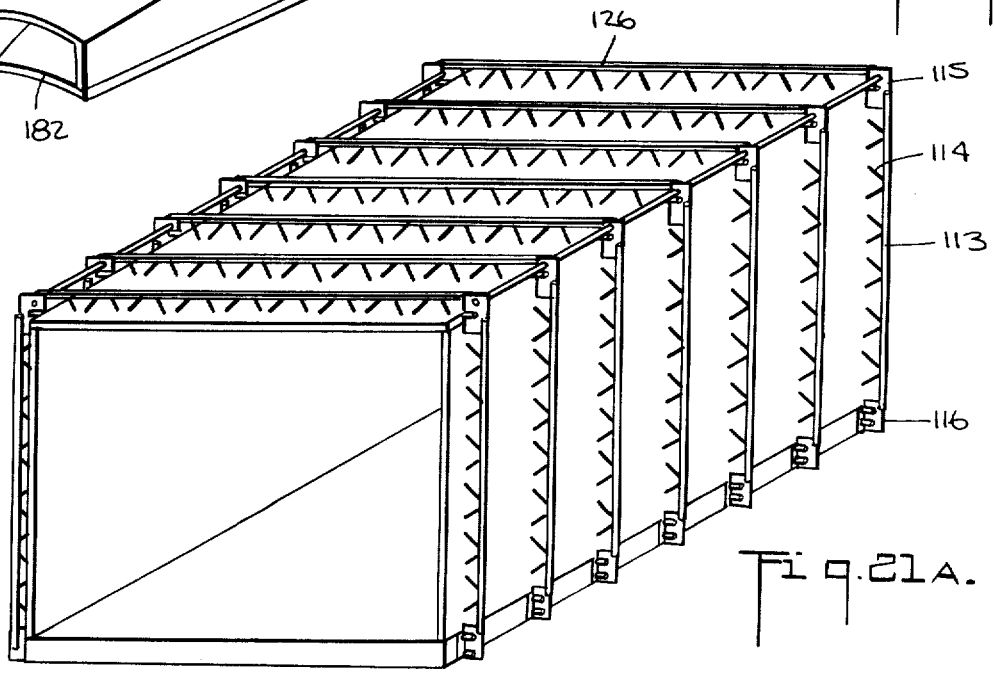
Fig. 21A.

Fig. 20.
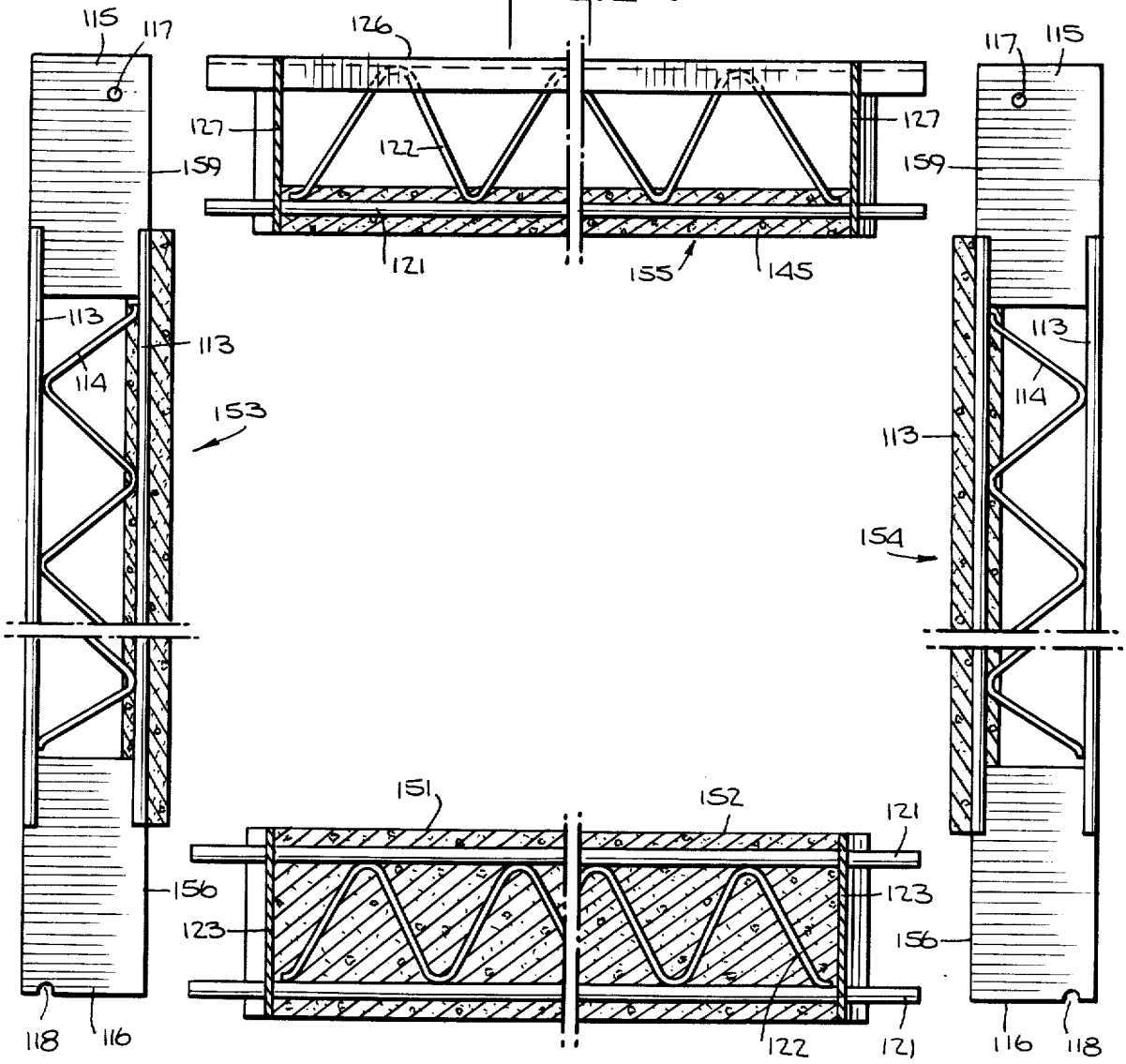
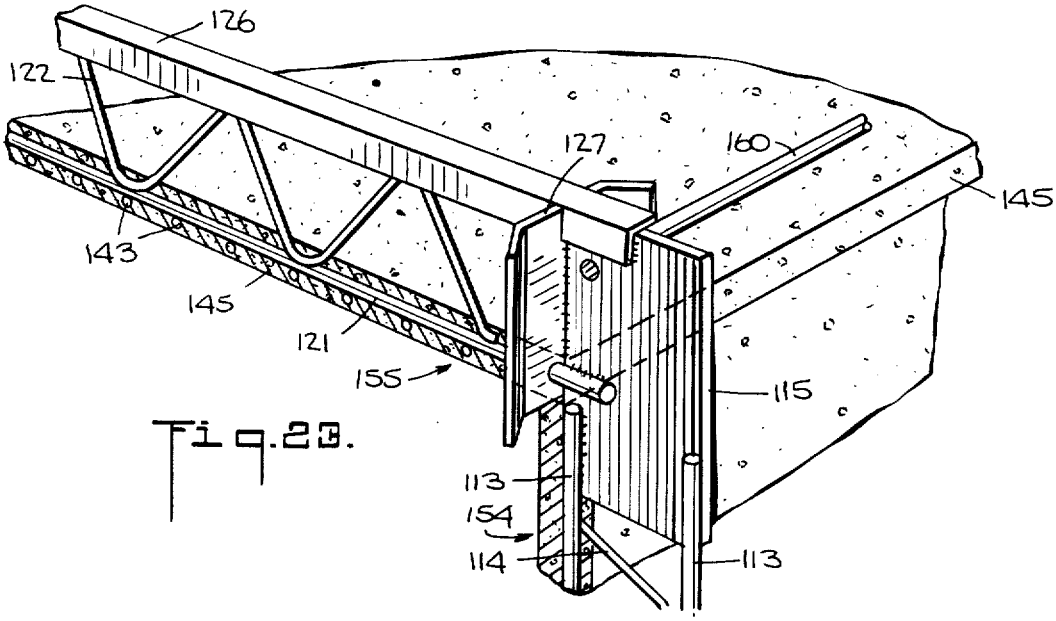
Fig. 23.

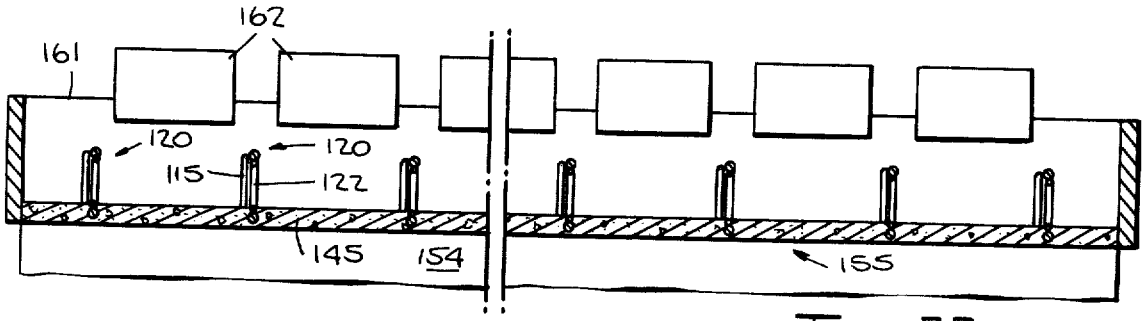
Fig 25.
Fig 27.
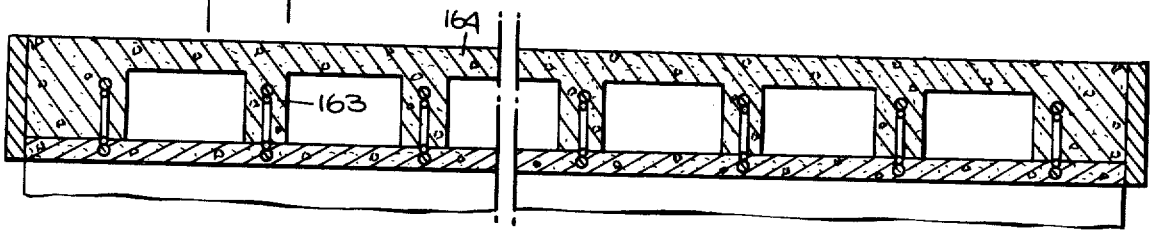
Fig. 26.
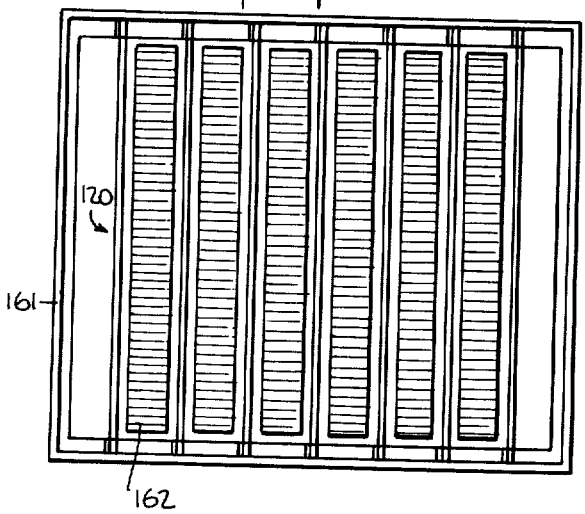
Fig. 30.
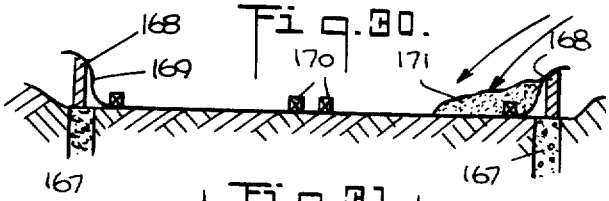
Fig. 31.
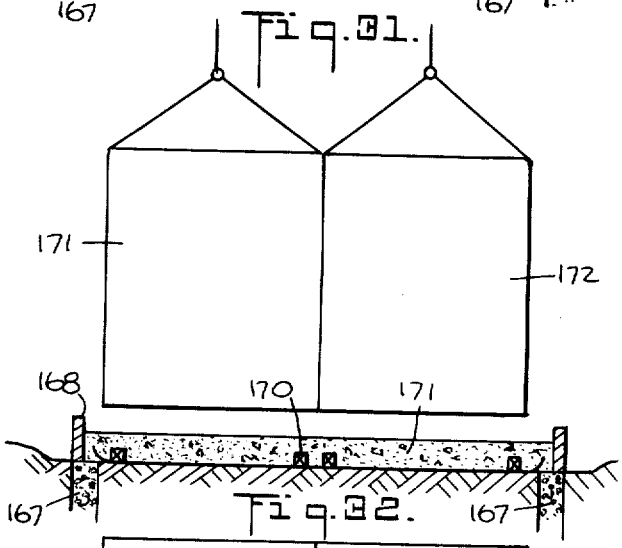
Fig. 28.
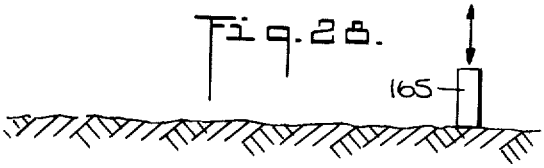
Fig. 32.
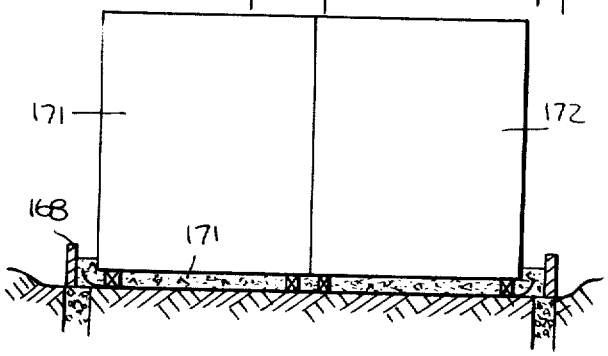
Fig. 29.
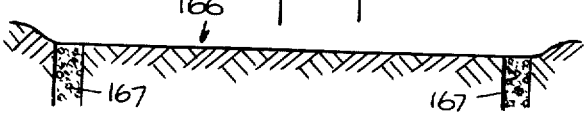

177
179
180
178

169
119
152
171

34
34
152
113
153
173
176
170
173
115
114
154
116
170
162
152
171
170
153
175
116
115
114
113
172
174
169

LIGHTWEIGHT BUILDING MODULE

BACKGROUND OF THE INVENTION

1. Field of the Invention

The present invention relates to the design and method of construction of lightweight building modules and to methods of installing such modules at a building site.

2. Description of the Prior Art

A complete modular building system using a prefabricated lightweight building module comprising thin reinforced concrete wall and ceiling panels attached to a floor slab is described in U.S. Pat. No. 3,990,193, issued on Nov. 9, 1976, of which the applicant herein is a joint inventor.

In the preferred module design disclosed in that patent, each ceiling panel and wall panel includes a thin, continuous layer of concrete having spaced apart open web bar girders embedded in one surface thereof. Each bar girder is a welded assembly having a continuous zig-zag bent bar forming an open web extending between one side edge comprising two straight round bars welded to opposite sides of alternate bends of the zig-zag bar and another side edge comprising two straight angle bars welded to opposite sides of the bend intermediate the first-mentioned alternate bends.

Each of the open web reinforcing bar girders of the side wall and ceiling panels of the patent terminate in a flat connection plate, and when the panels are assembled with a matching floor slab, one edge of each ceiling girder connection plate is butt welded to a contiguous edge of the upper connection plate of the corresponding side wall girder.

The floor slabs shown in the patent have no similar open web reinforcing bar girders. Instead, preshaped reinforcing steel bars are placed in forms and tied together in the conventional manner prior to pouring the concrete for the floor slabs. At spaced intervals along the opposite sides of each floor slab flat plates are welded to the adjacent reinforcing bars to provide steel surfaces to which the adjacent vertical edges of the lower connecting plates of the corresponding side wall reinforcing girders can be welded.

Under field assembly conditions it has been found that obtaining sufficiently accurate alignment of the upper side wall girder connection plates with the corresponding ceiling girder connection plates to permit butt welding the adjacent edges of the two plates is difficult and time consuming. Furthermore, bending moments exerted by racking forces on the module place such butt welds in tension, which is undesirable in view of the relatively low tensile strength of the deposited weld metal.

The same problem is inherent in the edge welds between the lower connection plates of the side wall girders and the side plates of the floor slab. In addition, the design of the floor slab provides no continuity from one side to the other for distributing the moment forces exerted through the connection of each side wall girder to the floor slab.

SUMMARY OF THE INVENTION

The present invention provides an improved building module design using open web reinforcing member of significantly lighter construction, yet of strength equal to the bar girders of the type disclosed in the above-mentioned U.S. Pat. No. 3,990,193. Also provided is a rigid moment joint connection design that simplifies module assembly, reduces assembly time, and provides joint connections of increased strength.

The present invention also includes an improved method of assembling lightweight building modules and an improved method of installing such modules at a building site.

In particular, the present invention provides a prefabricated building module in the form of a box comprising at least two opposing side wall portions, a ceiling portion and a floor portion, each of the two side wall portions and the ceiling portion including a thin layer of concrete-like material and a plurality of elongated metallic reinforcing members extending approximately vertically across one surface of the thin layer of each side wall portion in the manner of studs and extending across the one surface of the ceiling portion in the manner of joists, with one edge portion of each reinforcing member being embedded in the one surface and the other edge portion of each reinforcing member extending outwardly therefrom, and a means rigidly attaching the reinforcing members of each of the side wall portions to corresponding reinforcing members of the ceiling portion and to the floor portion for forming a rigid, box-like structure, wherein the improvement comprises:

a plurality of elongated metallic reinforcing members extending in spaced relation transversely of the floor portion in line with the respective lower ends of the side wall reinforcing members and the means for attaching the lower end portions of the reinforcing members of each of the side wall panels to the edges of the floor portion adjacent thereto comprise means for rigidly attaching each of said lower end portions to the end portion of the reinforcing member of the floor portion adjacent thereto.

Preferably, each of the elongated metallic reinforcing members of the side wall portions, ceiling portion, and floor portion comprises straight bars defining the spaced edge portions of the reinforcing member and a bar bent into a zig-zag shape defining an open web portion of the reinforcing member, the longitudinal spacing of the zig-zag bends being greater in the central portion of the reinforcing member than in the opposite end portions.

In addition, preferably the edge portions of each of the elongated metallic reinforcing members of the side wall portions, ceiling portion and floor portion comprise spaced apart straight bars, the means for rigidly attaching each reinforcing member of each of the side wall portions to a corresponding reinforcing member of the ceiling portion comprises a flat steel upper connecting plate, predetermined lengths of the upper ends of the straight bars of each side wall reinforcing member being lap welded to a face of the upper connecting plate, and predetermined lengths of the ends of the straight bars of the adjacent reinforcing member of the ceiling portion also being lap welded to a surface of the same upper connecting plate.

In a preferred embodiment, the means for rigidly attaching each of the lower end portions of the side wall reinforcing members to the end portion of the reinforcing member of the floor portion adjacent thereto comprises a flat steel lower connecting plate, predetermined lengths of the lower ends of the straight bars of each side wall reinforcing member being lap welded to a face of the lower connecting plate, and predetermined lengths of the ends of the straight bars of the adjacent reinforcing member of the floor portion also being lap welded to a surface of the same lower connecting plate, whereby the respective ceiling, wall, and floor reinforcing members are rigidly connected by a flat connecting plate at each junction to form a series of spaced rigid annular frames from adjacent one end of the box-like module to adjacent the other end of the module.

The method of constructing a lightweight building module according to the invention comprises:

(a) fabricating a plurality of open web side wall reinforcing members;

(b) fabricating a plurality of open web ceiling reinforcing members and floor reinforcing members;

(c) placing a predetermined number of the open web side wall reinforcing members in spaced parallel relation with the planes of the open webs vertical, on a flat pad inside an open side wall panel form, the opposite ends of each reinforcing member extending by predetermined amounts beyond opposite sides of the form corresponding to the bottom and top edges, respectively, of a side wall panel;

(d) pouring concrete onto the pad inside the form to a predetermined depth sufficient to encase one edge of each reinforcing member therein, with the remainder of each reinforcing member extending above the surface of the concrete, the concrete when hardened forming a panel of predetermined size and thickness and having the opposite ends of each reinforcing member extending a predetermined distance beyond respective edges thereof;

(e) repeating steps (c) and (d) to form an additional reinforced concrete side wall panel;

(f) placing an equal predetermined number of the open web ceiling reinforcing members in spaced parallel relation with the planes of the open webs vertical, on a flat pad inside an open ceiling panel form, the opposite ends of each reinforcing member extending by predetermined amounts beyond opposite sides of the form corresponding to the opposite side edges of a ceiling panel;

(g) repeating step (d) to form a reinforced concrete ceiling panel;

(h) placing an equal predetermined number of the open web floor reinforcing members in spaced parallel relation with the planes of the open webs vertical, on a flat pad inside an open floor slab form, the opposite ends of each reinforcing member extending by predetermined amounts beyond opposite sides of the form corresponding to the opposite side edges of a floor slab;

(i) pouring concrete inside the form to a predetermined height sufficient to encase at least a portion of the reinforcing members therein, the concrete when hardened forming a slab of predetermined size and thickness and having the opposite ends of each reinforcing member extending a predetermined distance beyond respective side edges thereof;

(j) positioning one of the side wall panels perpendicular to the plane of the floor panel, with the lower edge of the side wall panel adjacent to one side edge of the floor slab, and with the exposed lower end of each side wall reinforcing member in overlapping contact with the exposed end of the corresponding floor reinforcing member;

(k) lap welding the lower end of each side wall reinforcing member to the contiguous end of the corresponding floor reinforcing member to form a series of rigid moment joint connections;

(l) repeating steps (j) and (k) for rigidly connecting the other side wall panel to the other side of the floor slab;

(m) positioning the ceiling panel with the side edges adjacent to the top edges of the corresponding side wall panels and with the exposed upper end of each reinforcing member of each side wall panel in overlapping contact with an exposed end of the corresponding ceiling reinforcing member, (n) lap welding the upper end of each side wall reinforcing member to the contiguous end of the corresponding ceiling reinforcing member, thereby forming a building module having a series of spaced rigid annular reinforcing frames extending from one end to the other end of the module, each frame comprising corresponding side wall, floor, and ceiling reinforcing members welded together at the ends thereof into rigid moment joint connections, and (o) installing cross-bracing steel bars at the ends of the modules whenever the modules are to be subjected to considerable lateral forces.

Finally, the method of the invention for installing a building module at building sites at which the conditions and capacity of the soil can only sustain low loading capacity comprises:

preparing a substantially level area of ground compacted sufficiently to sustain the evenly distributed weight of a modular building of predetermined size;

distributing a layer of thin mortar over at least a portion of the area as large as at least one module; and placing at least one module in the layer before the mortar hardens, such that the weight of the module is evenly distributed over all the horizontal surfaces of contact between the bottom of the module and the mortar, whereby the weight of the module will be distributed evenly over the full projected area thereof when the mortar hardens.

Further details of the module and the methods of construction and installation are provided by the drawings and the following description of the preferred embodiments.

BRIEF DESCRIPTION OF THE DRAWINGS

FIGS. 11 through 14 illustrate the method of forming a ceiling panel according to the invention.

FIG. 15 is a perspective view of a plastic support bench used to hold wire mesh reinforcement in spaced relation above the bottom of the form.

FIG. 16 is a perspective view of a form arrangement for casting concrete floor slabs.

FIG. 17 is a perspective view of the form arrangement of FIG. 16 with open web floor joists installed in place and wire mesh reinforcement laid on top.

FIG. 18 is a perspective view of the floor slab form arrangement after concrete has been poured and levelled.

FIG. 19 is a perspective exploded view of a module according to the invention.

FIG. 20 (Sheet 7) is an end view in section of the floor, wall, and ceiling panels of a module in the same relative positions as shown in FIG. 19.

FIG. 21A (Sheet 5) is a perspective view of the assembled module of FIG. 19.

FIG. 23 (Sheet 7) is a detail view in perspective of a rigid moment corner joint assembly between one end of a ceiling panel joist and the upper end of a wall panel studding member.

FIGS. 25–27 illustrate the steps of pouring a roof slab on top of an essembled module.

FIGS. 28–32 illustrate schematically the steps of preparing a foundation site and setting the modules according to the method of the invention.

FIG. 36 (Sheet 5) is a perspective view of the module of FIG. 35.

FIG. 37 (Sheet 5) is a perspective view of a module having a shape in plan of a sector of an annulus and a rectangular cross section in elevation.

DETAILED DESCRIPTION OF THE PREFERRED EMBODIMENTS

Figure 1:
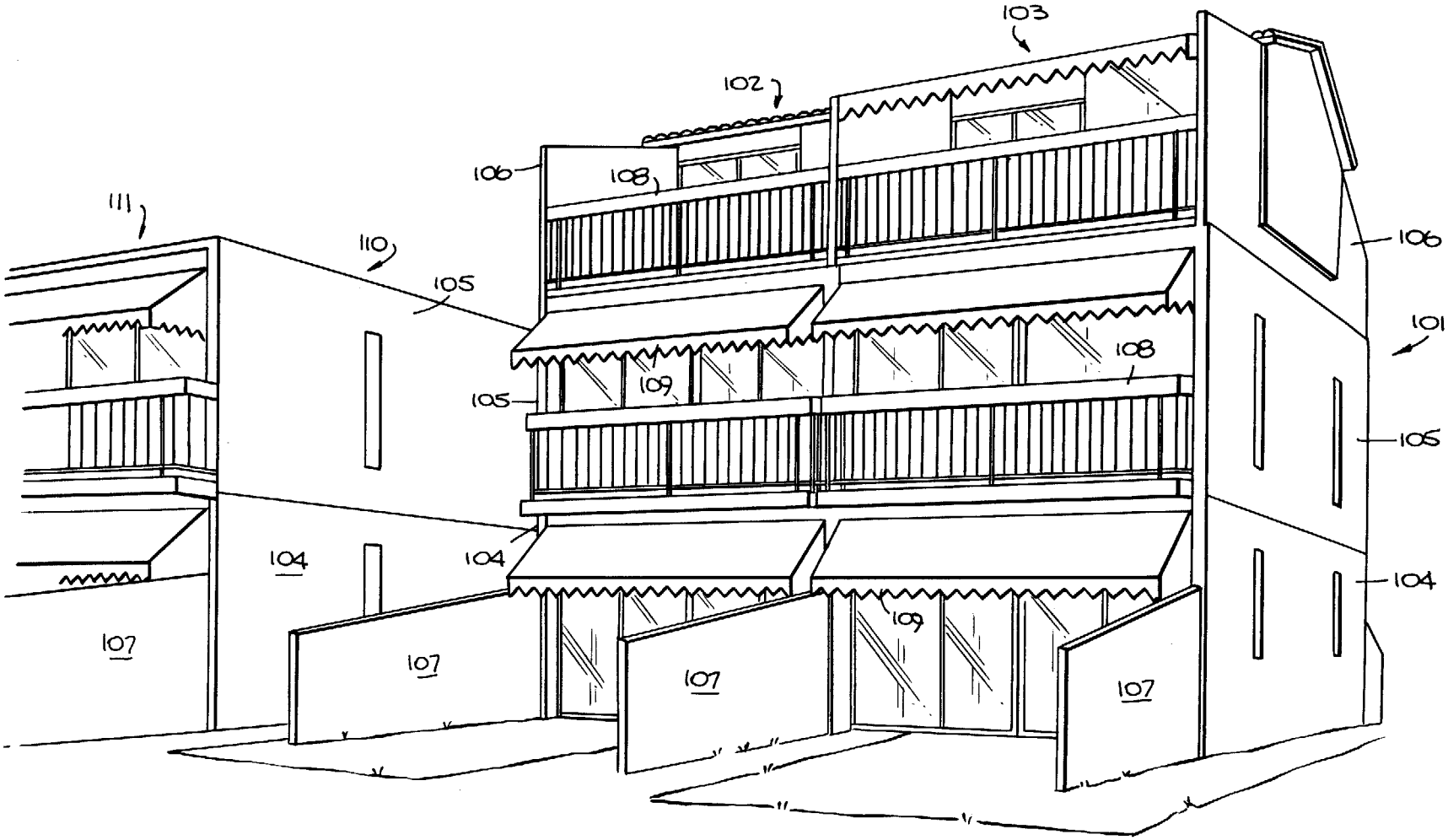
FIG. 1 is a perspective view of multiple-unit housing structures employing the improved building modules and methods of assembly and erection of the present invention.

FIG. 1 provides an example of the architectural flexibility possible with the modular building units according to the invention. In the foreground is a multi-unit building 101 comprising two triplex apartments 102, 103, each of which is assembled from three modules 104, 105, 106 stacked one on top of another. The first floor modules 104 are identical, as are the second floor modules 105 and the third floor modules 106.

Each module is assembled from a precast reinforced concrete floor slab, wall panels, and ceiling panel. The forms and reinforcing elements for the floor slabs of all the modules are identical, except for easily changed inserts to provide stairway wells and other openings. The same is true for the wall panels and the ceiling panels of the first and second story modules 104 and 105. The wall panels for the third story modules 106 are peaked to provide a sloping roof line, so they must be cast in a separate form. Two ceiling panels are used for each of the third story modules 106; both are full width but are shortened to equal, respectively, the length of the wall panels rearwardly of the peak and a shorter length forward of the peak to provide an open sun terrace, as shown. These panels are made in the same forms as the full-length ceiling panels of the first and second story modules, however, simply by positioning a temporary transverse barrier at the proper location on the form.

Thus it is apparent that with minor variations, a minimum number of forms can be used to produce modules having substantially varied appearance, the variation being enhanced by additional details such as partitions 107, railings 108, and awnings 109.

For further variation and to add visual interest, the adjacent building 110 is constructed as duplex apartments 111 having a flat roof, but otherwise assembled from the same components.

The individual elements and subassemblies of each module and the methods of assembling modules and erecting buildings according to the present invention will be described in detail in connection with the rest of the drawings.

With reference to FIGS. 2–10, various features and details of the principal reinforcing members for the floor, wall, and ceiling panels of the modules are shown.

Figures 2, 3, 4, 5, 6, 7, 8, 9, 10:
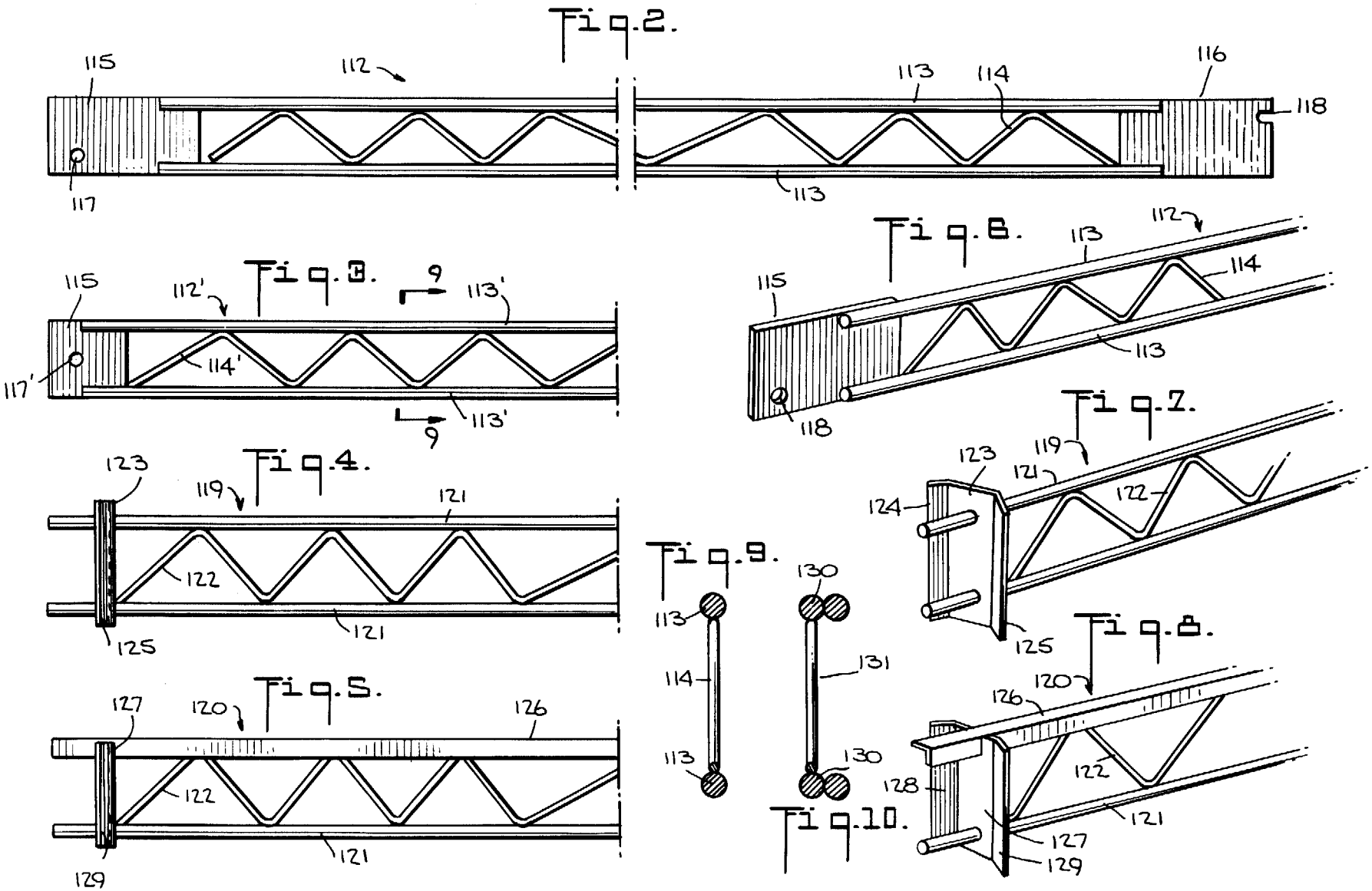
FIG. 2 is a side view of the two ends of a fabricated open-web girder used as a wall studding member for the building modules of the invention.
FIG. 3 is a side view of the upper end of an auxiliary wall girder.
FIG. 4 is a side view of one end of an open web girder used as a floor joist member for the building modules of the invention.
FIG. 5 is a side view of one end of an open web girder used as a ceiling joist for the building modules of the invention.
FIG. 6 is a perspective view of the upper end of the wall studding member of FIG. 2.
FIG. 7 is a perspective view of one end of the floor joist member of FIG. 4.
FIG. 8 is a perspective view of one end of the ceiling joist member of FIG. 5.
FIG. 9 is an end view in section of the wall studding member of FIG. 2 taken on line 9—9 of FIG. 3.
FIG. 10 is an end view in section of an alternate embodiment of the wall studding member of FIG. 2.
Figure 21B:
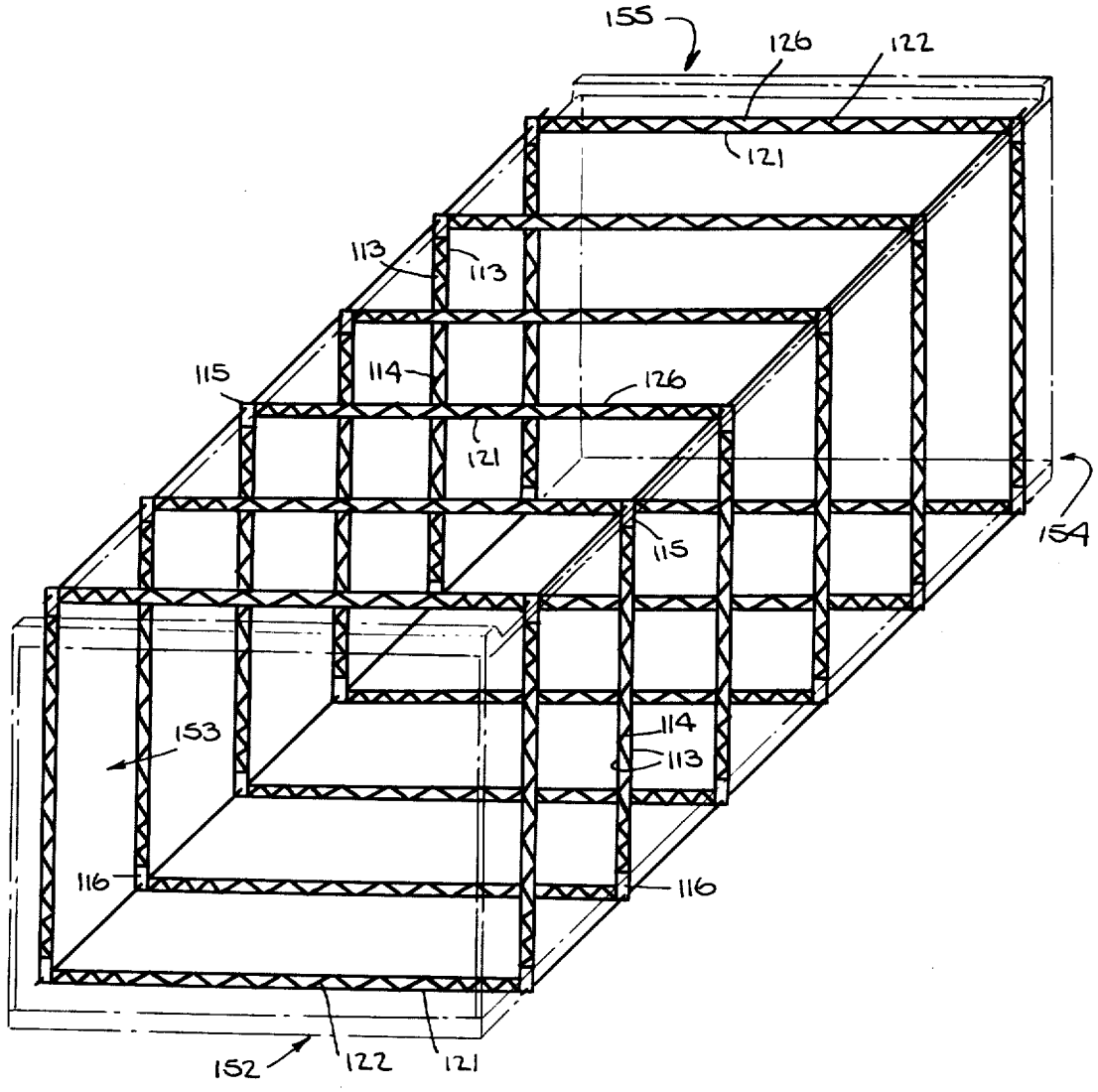
FIG. 21B (Sheet 6) is a perspective view of the assembled module of FIG. 19 showing the annular frames but without showing the concrete.

FIGS. 2 and 6 illustrate a typical wall panel studding member 112 which is fabricated by welding together five separate parts: two identical straight bars 113, spaced apart by an open web member 114 in the form of a zig-zag bent round bar, and terminating in an upper connection plate 115 at one end and a lower connection plate 116 at the other end.

The zig-zag web member 114 is bent in a specific predetermined pattern with variable longitudinal spacing between successive bends, depending on the calculated local bending moments on each stud member. Since the connection plates 115, 116 act as rigid moment connectors for the assembled module units (as will be explained later) the spacing of the zig-zags is closer at the ends of the member, where the moments are highest. In this way, the resulting stud member has minimum weight, yet its strength is precisely tailored to meet the imposed loads at every point.

For uniformity and reduced labor, the individual components are assembled in fixtures on an assembly line and welded together at each contact point. The result is a unitary structure made up of simple basic steel bars and rectangular plates. The upper connection plate 115 has a prelocated hole 117, and the lower connection plate has a prelocated notch 118 for purposes to be described below.

FIG. 3 illustrates the upper end of an auxiliary wall studding member 112' that is similar in design to member 112 and of the same overall length, but with longer longitudinal bars 113' and zig-zag open web member 114' and a shorter upper connection plate 115'. The auxiliary studding members may be used in a precast auxiliary wall panel similar to the wall panels intended for assembly into modules, but used to finish the outside wall of an end module of a building.

FIGS. 4 and 7 show one end of a reinforcing joist 119 for a floor slab, and FIGS. 5 and 8 show one end of a similar joist 120 for a ceiling panel. In each case the other ends are identical. Floor joist 119 is assembled from five components, including two straight bars 121 and a zig-zag open web member 122,, just as in wall stud member 112. At the ends of each floor joist 119, however, there is no connection plate comparable to the plate at each end of stud member 112. Instead, a clamp plate 123, having two holes sized and spaced to slide over the ends of straight rods 121, is welded to the rods at a position spaced from the ends, so that a predetermined length of each rod extends beyond the outer face of the clamp plate. The clamp plate has two bent wings 124, 125 to give it the form of an outward facing channel, for a purpose to be described later.

The open web ceiling joist 120 of FIGS. 5 and 8 is almost identical to the floor joist 119 except that one of the straight rods 111 is replaced by an angle bar 126 to provide a flat bearing surface for corrugated asbestos roof panels and a means for attaching clips to hold such panels in place. For modules that are intended to form the lower stories of a multi-story building or to form part of a monolithic poured concrete roof (as described below), round bars can be used as both the top and bottom straight rods of the ceiling joist members. The ceiling joist also has a clamp plate 127 with angled wings 128, 129, similar to clamp plate 123, except that the upper hole is replaced by a notch to accommodate the vertical flange of angle bar 126. As in the case of the other reinforcing members, ceiling joist 120 is securely welded together at every contact point between the straight bar 121, angle bar 126 and zig-zag open web member 122, as well as at the clamp plates 127 at each end to form a strong yet light-weight unitary reinforcing girder.

For extra-wide wall or floor panels, or for extra-heavy design loads, the alternate joist embodiment of FIG. 10 may be used. This comprises two pairs of straight rods 130 and a zig-zag open web member 131 welded to opposite sides of the rods.

With reference next to FIGS. 11–14, the method of forming module panels by means of the open web members of FIGS. 2–10 is illustrated in the case of a ceiling panel. As shown in FIG. 11, as a preparatory step a flat, level concrete pad 132 is poured and finished off as smoothly as possible. A low form frame 133 is fastened down onto the pad, the frame being the exact size of the finished ceiling concrete panel and the height of the frame being equal to the desired thickness of the concrete panel.

The longitudinal sides of frame 133 have spaced gaps 134, as best seen in FIGS. 12 and 14. Ceiling joist members 120 are dropped into place so that a lower bar 21 of each joist extends through each corresponding gap. Beveled blocks 135, 136 (see FIG. 14) on either side of each gap serve as guides for the respective wings 124, 125 of each corresponding clamp plate 123, to hold the joists 120 upright in properly spaced position and also to seal the gaps in the form.

To further assure that the joists are held firmly in position during the ensuing concrete pouring operation, angle brackets, 137, 138 are fastened to a spacer board 139 on either side of each gap 134. Aligned holes 140, 141 (FIG. 11) in the upright portions of respective brackets 137, 138 accept a pin 142 that locks the lower straight rod 121 of each joist 120 a small distance above the pad, as determined by the thickness of spacer board 139.

Before the ceiling joists are set into the form frame and locked into place, the form should be coated with release material, and wire mesh reinforcement 143 should be laid down on the pad inside the form, as shown in FIGS. 11 and 12. The mesh should be held approximately ⅜" above the pad by suitable supports, such as small plastic pyramids or benches 144 shown in enlarged detail in FIG. 15.

After the joists are locked in place, concrete is poured into the form and levelled to the height of form 133, which may be no more than 1½ to 1¾ inches for panels as large as 12 feet wide and 24 feet or more in length. As shown in FIG. 13, the thin concrete layer 145 encases not only the wire mesh but also the lower bar 121 of each joist 120. When the concrete hardens, therefore, the open web joists provide integrated reinforcement for the panel, the entire structure having a very high strength to weight ratio.

Wall panels for the module are precast in exactly the same way as the ceiling panels, except that a simple vertical slot arrangement is all that is needed to support and hold the connection plates 115 and 116 at the respective upper and lower ends of the studding members. In the cases of both ceiling panels and wall panels, after the poured concrete layer has cured to suitable strength, the panel can be removed from the form simply by attaching strongbacks to the exposed bars 121 of the open web joists adjacent to each of the longitudinal sides of the panel. By attaching a bridle to the strongbacks, the panel can be lifted by a crane and transported to a module assembly area. In the case of a wall panel, it is preferable to use only one strongback attached to the open web studding members adjacent to the intended upper edge (i.e., top) of the panel. By attaching a bridle to the strongback and lifting, the wall panel pivots easily about its lower edge until it stands vertically. The panel can then be raised off the ground by the same bridles and transported to a module assembly area.

The floor panels are cast in reverse, so that the smooth interior surface of the panel (i.e., the floor surface) faces upward instead of downward against the surface of the pad. The steps in setting up and pouring a floor slab are shown in FIGS. 16–18.

The foundation of the form for floor panels is a flat level concrete pad, just as for the ceiling panel form. A rectangular form frame 146 is set on the pad, as before, but the height of the frame in this case is equal to the full depth of the floor slab. The longitudinal sides of the frame have spaced gaps 147, also as before, and aligned with these gaps inside the frame are a plurality of spaced platforms 148 fastened to the pad. The spacing between the platforms establishes the thickness of concrete cross and longitudinal ribs extending below the under surface of the finished floor slab. The vertical distance between the level of the tops of the platforms and the top edge of the form frame establishes the thickness of the floor slab.

The first step in making a floor slab (after coating all of the form surfaces with a release, agent) is to position an open web floor joist 119 in each transverse space 149 between adjacent platforms 148, with the clamp plates 123 at the ends of each joist fitted to the gaps in the sides of form 146, just as in the previously described method for fabricating the ceiling panels. After all the floor joists are locked in place, wire mesh reinforcement 143 is laid on top, as shown in FIG. 17. Plastic support benches 144 (FIG. 15) should be used to space the wire mesh above the tops of the platforms 148 in the same manner as previously described for the ceiling panel. In addition, other reinforcing bars, as required, should be placed in the longitudinal center space 149 and the peripheral space 150 between the inside of the form frame 145 and the adjacent platforms.

After all the reinforcing members have been positioned inside the form, concrete is poured into the form and levelled to the upper edge of frame 145, as shown in FIG. 18. Since the surface 151 of the concrete will become the floor of the module, it is finished smooth and flat by conventional trowelling methods.

When the concrete of the floor slab has cured to sufficient strength, the form frame 146 is stripped from the perimeter of the slab. This leaves the ends of the straight bars 121 extending outward from shallow vertical grooves or notches formed at spaced intervals along the side edges of the floor slab by the channel-shaped clamp plates 123. The floor slab is then used as a module assembly station.

With reference to FIGS. 19, 20, 21A and 21B, a floor slab 152 is shown with wall panels 153, 154 and a ceiling panel 155 arranged in proper position to form a rectangular modular unit when assembled together. The assembly sequence is to transport the two walls, one at a time, by means of a strongback clamped to the stud members near the top edge, from a storage yard, or directly from their casting pads if the production schedule of the panels is properly synchronized. Each panel is suspended substantially vertically and guided until the lower portion of each connection plate 116 is contiguous to the exposed ends of the corresponding straight bars 121 of the floor joists and until the inboard edge 156 of each connection plate 116 bears against the face of the corresponding clamp plate 123.

Figure 22:
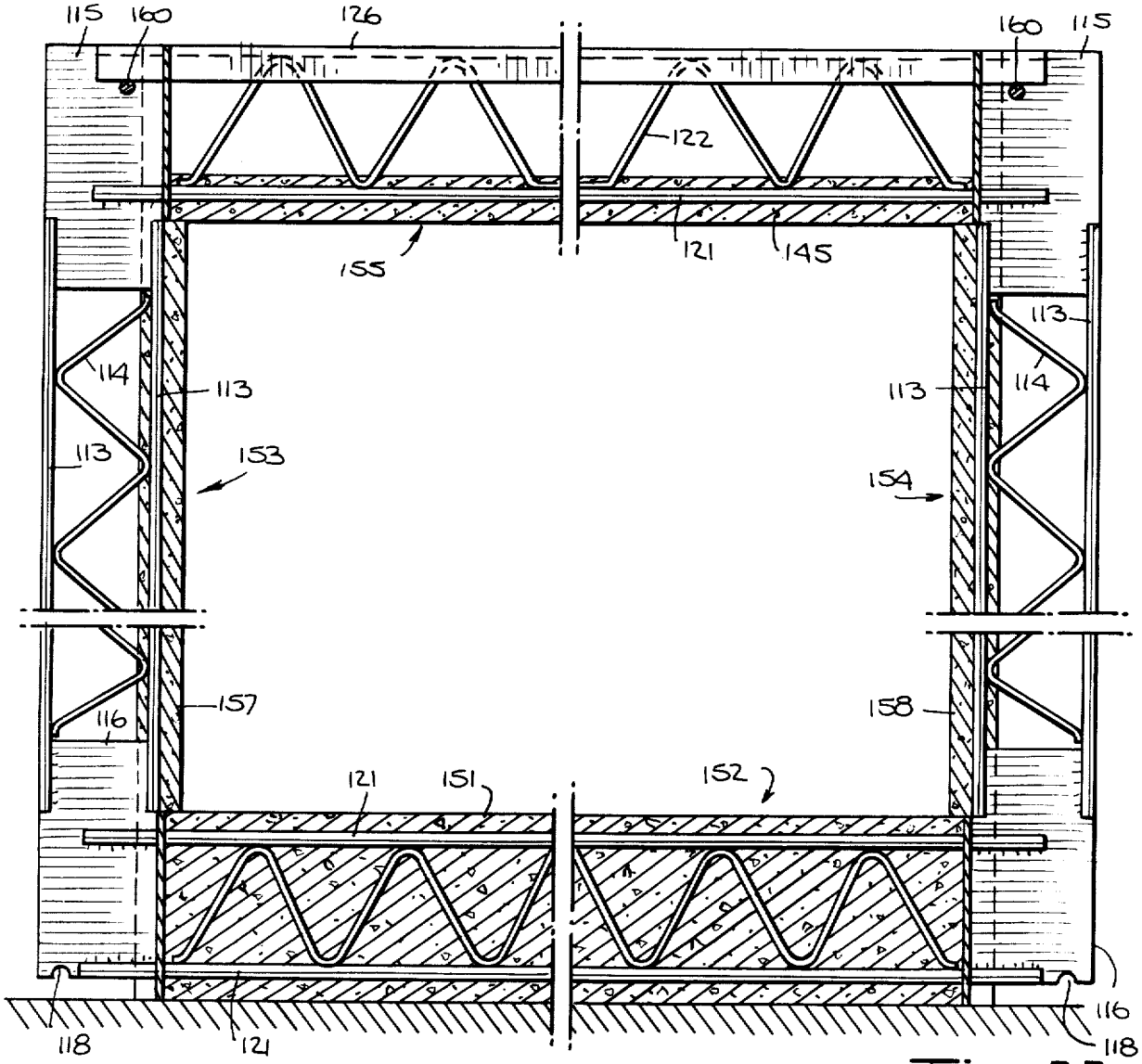
FIG. 22 (Sheet 8) is an end view in section of the assembled module shown in FIG. 21.
Figure 24:
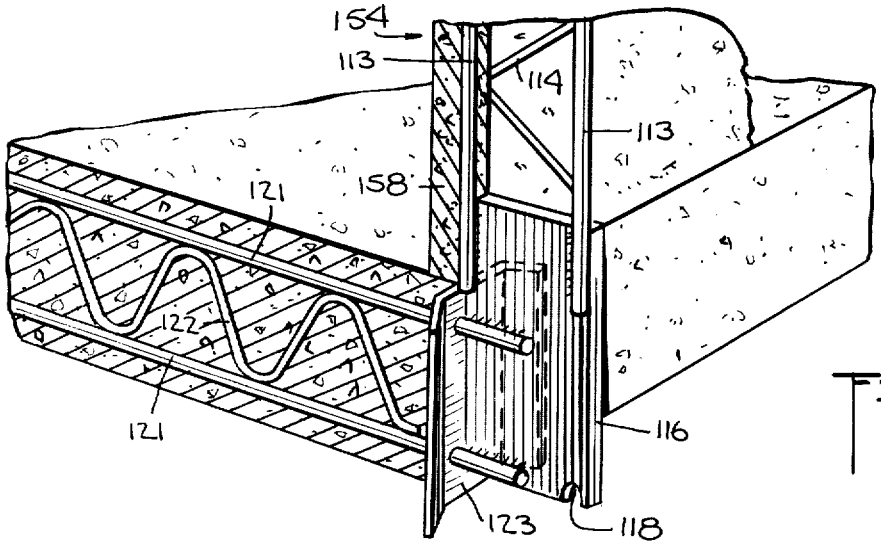
FIG. 24 is a detail view in perspective of a rigid moment corner joint assembly between one end of a floor panel joist and the lower end of a wall panel studding member.

Referring at this point to FIGS. 22 and 24, it can be seen that the outer faces of concrete layers 157, 158 of the wall panels 153, 154, respectively, are then aligned with the longitudinal edges of the floor slab 152. Because the joists of the floor slab and the studding members of the wall panels have been positioned accurately in their respective panels by the form arrangement described above, the spacing between joists and studs is uniform, so that good contact is made between the respective rod ends and connection plate of each joist/-stud pair.

After the aligning step for the first wall panel is completed, the rod ends of each floor joist member are welded along their exposed length to the adjacent face of the corresponding connection plate 116, and the inboard edge of the connection plate is welded to the adjacent face of the corresponding clamp plate 123. It is apparent from FIG. 24 that the resulting connection between each wall stud and the corresponding floor joist provides a rigid moment joint of high strength, yet of simple and light weight design that is simple to assemble and weld.

In particular, the arrangement whereby the rod ends are lapped against the face of the connection plate, and the edge of the connection plate is butted against the face of the clamp plate permits some degree of misalignment without adversely affecting the strength of the welded joints. Furthermore, bending moments on the joint are resisted in shear by the entire lengths of the welds between the rods 121 and the connection plate 116, rather than merely by the relatively weak tensile strength of the edge weld between the connection plate and the clamp plate.

After both wall panels have been assembled to the floor slab and welded, the ceiling panel can be lowered into place and the upper connection plate 115 of each wall studding member welded to the exposed ends of the round bar 121 and angle bar 126 of the corresponding ceiling joist. The inner edge 159 of each upper connection plate 115 also is welded to the face of the corresponding clamp plate 127 in the same manner as for the rigid moment joint connections between the walls and the floor slab. The resulting upper rigid moment joint connection is shown clearly in FIG. 23.

The final module assembly step is to insert a longitudinal round bar 160 (FIG. 23) through holes 117 in the upper connection plates and to weld the bar in place at each connection plate. These longitudinal rods provide an additional degree of stiffness and serve as convenient attachment members for lifting hooks to move the completed module to the building site. As described further below, longitudinal bars 160 also can act as stops to establish the desired spacing between the wall panels of adjacent modules in a multi-unit building.

From the foregoing description of the module assembly procedure, it is clear that, although each module is fabricated from four separate precast panels, the assembled module is transformed into an integrated structure comprising a series of spaced rigid annular rectangular rings, each ring being formed by a floor joist, two wall studding members and a ceiling joist welded together as shown in FIG. 22. These unitary lightweight rings, made up from the simplest bar and rectangular plate shapes, have exceptional rigidity against moment forces tending to rack the module.

The spaced straight bars and intermediate zig-zag bar of each joist and studding member create a diagonally braced girder of utmost construction simplicity and very high strength in comparison to its weight. The connections at each corner transmit moment forces through the longitudinal welds of the spaced straight bars of the joined girders. This design assures that the weld strengths at the corners will be commensurate with the buckling strength of the connection plates and girders, so that the welds are not a weak link in the finished structure.

EXAMPLE

To illustrate the very lightweight construction that results from the module design of the present invention, the following illustrative example of sizes and dimensions of the various components of a module 8 feet high (interior dimension), 12 feet wide (slab width), and 42 feet long is given:

| | |
|---|---|
| 1. Typical Wall Stud 112: | |
| Straight Bars: | 2 - No. 4 plain reinforcing bars × 8' - 0" spaced 3½" apart |
| Zig-Zag Bar: | 1 - No. 2 plain reinforcing bar |
| Upper & Lower Connection Plates: | 3½" × 7" × ¼" |
| 2. Typical Floor Joist 119: | |
| Straight Bars: | 2 - No. 4 plain reinforcing bars × 12' - 4" spaced 4½" apart |
| Zig-Zag Bar: | 1 - No. 2 plain reinforcing bar |
| 3. Typical Ceiling Joist 120: | |
| Angle Bar: | 1 - 1" × 1" × ⅛" × 12' - 4" |
| Straight Bar: | 1 - No. 4 plain reinforcing bar spaced 5" from angle bar |

-continued

| | |
|---|---|
| Zig-Zag Bar: | 1 - No. 2 plain reinforcing bar |

Approximately 2 linear inches at the end of each straight bar is welded to the corresponding connection plate.

| | |
|---|---|
| Thickness of concrete wall panels: | 1¼" (approx.) |
| Thickness of concrete ceiling panel: | 1¼" (approx.) |
| Thickness of concrete floor slab: | 1¼" (approx.) |
| Weight of assembled module: | 30,000 pounds (approx.) |

If other dimensions are used, the weight of the assembled module will change. As another example, a module as described above but 21 feet in length weighs approximately 18,000 pounds.

Another feature of the present invention is a lightweight, poured concrete roof structure for the module that provides a high degree of heat insulation. With reference to FIGS. 25–27, a rectangular form frame 161 is attached to the perimeter of a ceiling panel 155 of an assembled module. The height of the form is equal to the intended overall thickness of the roof.

Lightweight filler blocks 162 of appropriate size are then placed in each transverse space between adjacent ceiling joists 120. These filler blocks are made of corrugated cardboard and are available in a wide range of sizes and thicknesses. After the filler blocks are in place, concrete is poured over the ceiling panel up to the top of the form. The concrete flows into the spaces between the filler blocks to form, with the ceiling joists, a series of reinforced ribs integral with a relatively thin roof slab 164 after the concrete has hardened.

In this way a monolithic cast concrete ribbed roof slab is produced inexpensively with minimum labor. The roof has substantial insulating space provided by the filler blocks, which are light in weight and inexpensive. At the same time, the filler blocks are completely encased in concrete, thereby eliminating any potential fire hazard.

FIGS. 28–32 illustrate still another important feature of the construction method of the present invention. Foundations represent a significant cost in conventional building construction. In particular, multi-story buildings normally require extensive excavation for large footings. Foundation design is a particular problem in sandy soils adjacent to beach areas, for example, where there is no bedrock or other suitable load bearing substratum.

The method of building erection according to the present invention is particularly suited to such soil conditions. As shown in FIG. 28, the first step of the method is to compact the soil at the building site by means of any conventional compacting device, illustrated schematically by a tamper 165. After an area 166 corresponding to the base of an entire building, which may comprise a number of side-by-side modular units, has been compacted (FIG. 29), a grade beam or wall 167 is poured around the perimeter of the compacted area. The purpose of the grade beam is only to prevent undermining of the building foundation; it is not required to contribute any load bearing capability.

With reference next to FIG. 30, a form 168 is erected around the outer perimeter of the compacted area, and a vapor barrier 169 is laid inside the form. Levelling guide blocks 170 are next positioned within the compacted area at the planned location of each modular unit of the building, and then a grout of lean mortar (about 10-inch slump) is poured into the area surrounded by form 168 to a depth to cover the levelling guide blocks by a predetermined amount.

The thin grout allows a period of approximately two hours to place modules 172 and 173 into position before it starts to set. During this period, the modules are lowered into the fluid grout so that they essentially float in it, exerting just enough pressure on the levelling guide blocks to make positive contact on all of them without pressing them further into the ground, as shown in FIGS. 31 and 32.

When the modules have settled into place, each rib of the ribbed floor slabs is surrounded by and presses into the hardening grout, so that after the grout slab has cured, the weight of the building units is uniformly distributed by the mortar pad over the entire compacted area. The loading per unit area, therefore, is very low, even for buildings many stories high, and is well within the support capabilities of sandy soils.

Figures 33, 34, 35:
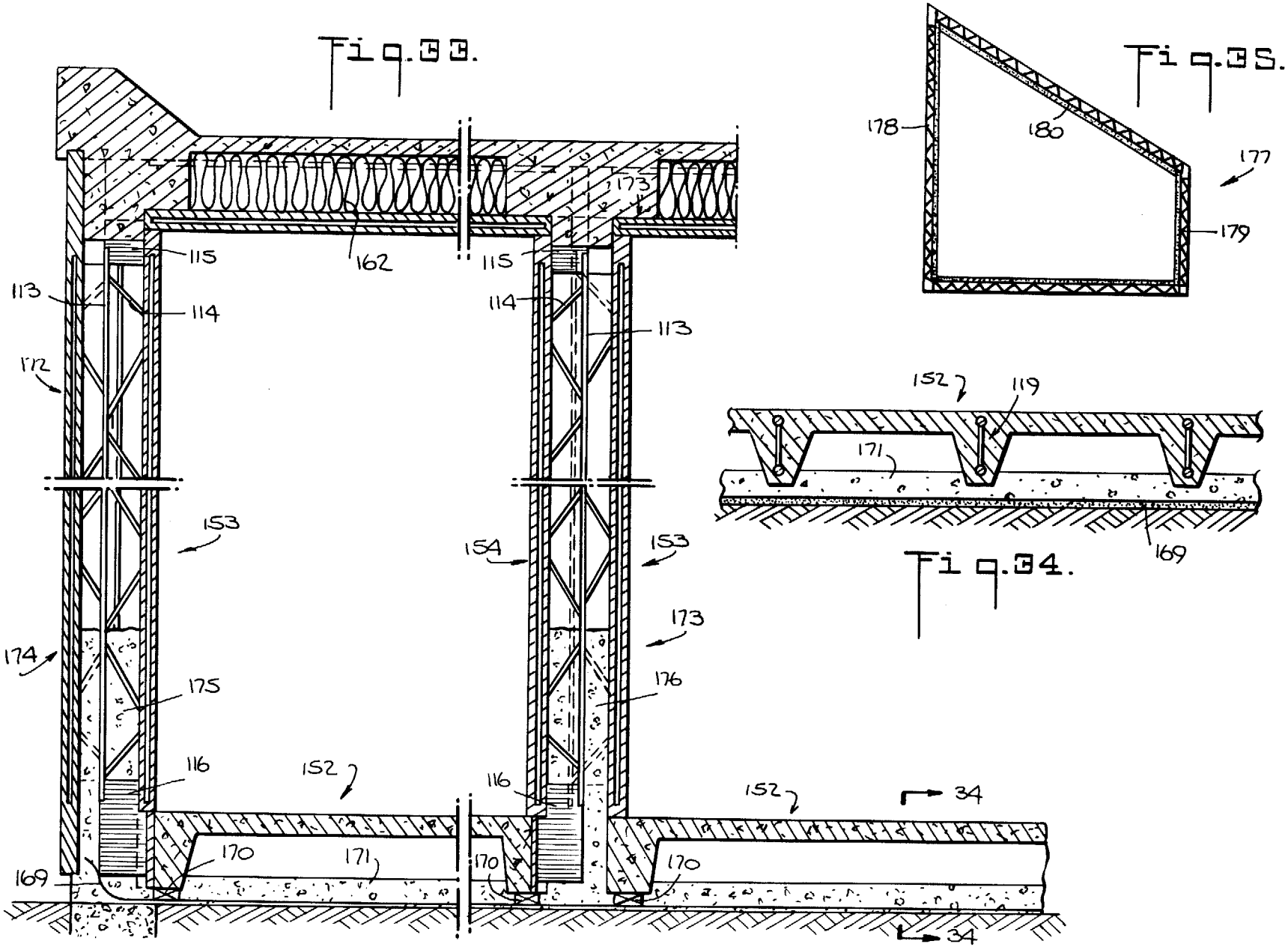
FIG. 33 is an end view in section of a portion of a completed one-story modular building according to the invention.
FIG. 34 is a partial sectional view of the floor slab and ground support pad of the modular building taken along line 34–34 in FIG. 33.
FIG. 35 is an end view in section of a module having a trapezoidal cross section in elevation.

FIGS. 33 and 34 illustrate the details of the foundation system, as applied to a multi-unit single story building having a monolithic poured concrete roof of the type previously described. As shown in FIG. 33, in particular, the adjacent modules 172 and 173 are positioned so that the wall stud members of wall panel 154 of module 172 nest between the stud members of wall panel 153 of module 172. The spacing between the two wall panels is established quickly and positively by longitudinal bars 160, each of which acts as a stop for the upper connection plates of the adjacent module.

As further illustrated in FIG. 33, wall panel 153 of module 172 forms part of an outside wall of the building. To provide a smooth exterior surface, an auxiliary wall panel 174 of similar construction is placed with its studding members 112' resting between the studding members of panel 153. The outer wall panel is held in place by at least partially filing the space between the panels with concrete 175. This produces a reinforced concrete wall of great strength. The space between the modules 172 and 173 is similarly at least partially filled with poured concrete 176.

Desirably the pouring of concrete between the wall panels is performed at the same time as pouring of the roof slab. The result is an integrated monolithic, reinforced poured concrete building in which the precast concrete module panels serve as integral forms which become incorporated into the subsequently poured concrete structure of the building.

As mentioned previously, the modular system of the present invention is adapted also to module shapes other than rectangular. FIGS. 35 and 36, for example, show a module 177 in which one wall panel 178 is higher than the other wall panel 179, so that the module has a sloping roof panel 180. Such a module shape can be used either along or in combination with an identical module to form a peaked roof house of traditional appearance (not shown).

An alternative wedge-shaped module 181 is shown in FIG. 37. Module 181 has floor and roof panels 182 and 183, respectively, that are in the shape of a sector of an annulus, so that module 181 is adapted to form a unit of a circular or annular building.

Although modules incorporating the annular ring girder structure of the present invention are exceptionally rigid, when such modules are used in a building of more than two or three stories it may be necessary to include additional bracing to guard against racking of the entire building due to lateral wind loading or earthquake forces.

Figure 38:
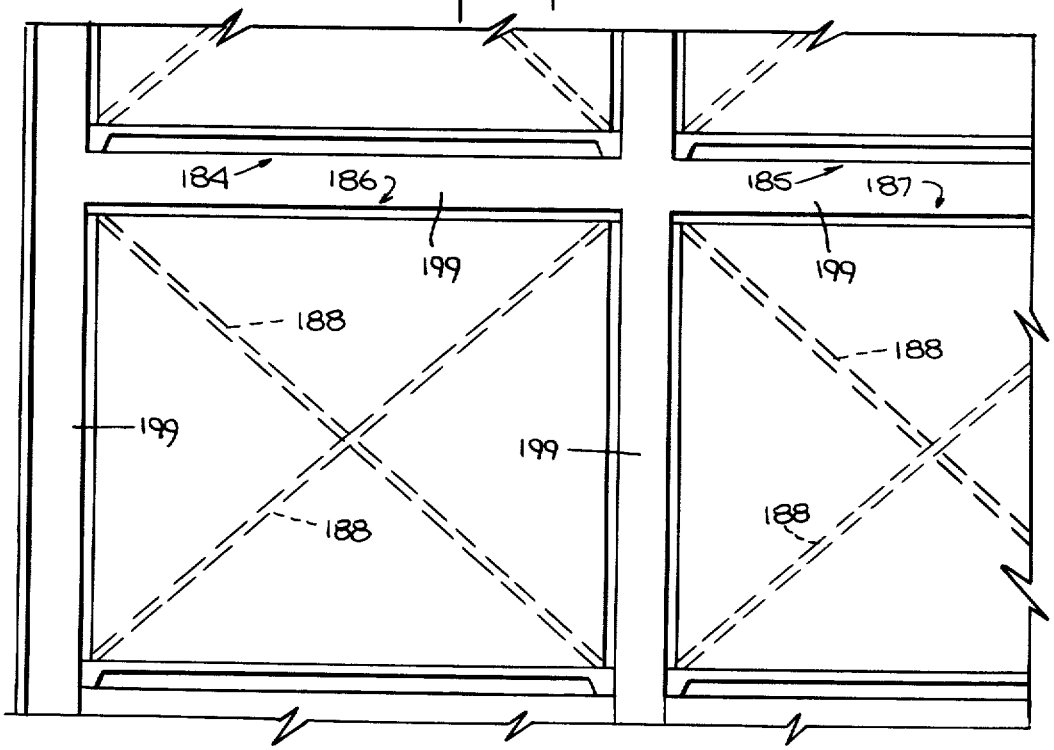
FIG. 38 is an end view of a portion of a multi-unit modular building having cross ties at the end of each modular unit to provide rigidity to the final structure.
Figure 39:
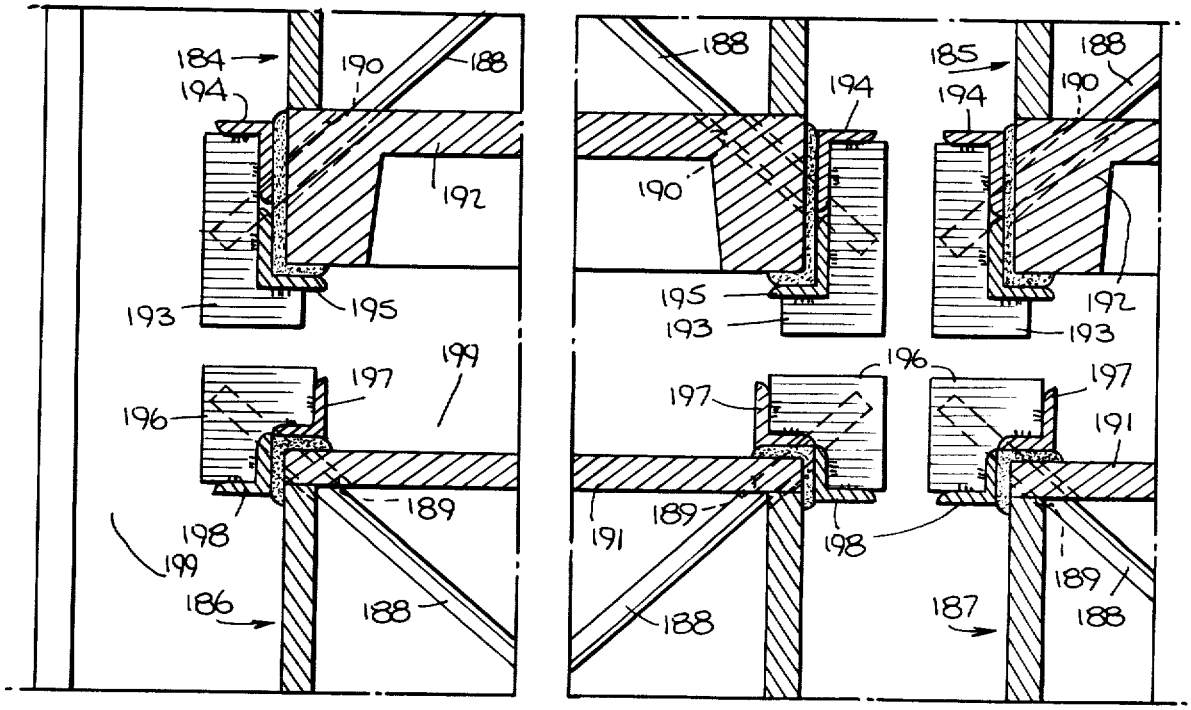
FIG. 39 is a partial detail view in section of the means for fastening the cross ties of FIG. 38 at the corners of each module.

With reference to FIGS. 38 and 39, the present invention also includes a cross bracing arrangement that can be used effectively for buildings of many stories. In this arrangement selected modules—usually at least one vertical stack of modules—are provided with cross-bracing at at least one end of each module, as shown schematically in FIG. 38. Although adjacent stacks of modules are shown cross-braced in FIG. 38, in many cases it may be necessary only to cross-brace a single vertical stack of modules at each end of a building, leaving the intermediate stacks of modules without extra cross-bracing.

The preferred bracing structure is illustrated in enlarged detail in FIG. 39, which shows partial views of corners of four adjacent modules 184, 185, 186 and 187. In each module the braces comprise at least one and preferably a pair of plain round bars 188 in each diagonal plane. Thus, one pair of bars will extend from the upper right to lower left corner, and the other pair of bars will extend from the upper left to the lower right corner.

As shown in FIG. 39, the bars extend through drilled holes 189, 190 in the opposite edges of the ceiling panels and floor slabs 191, 192, respectively, of the modules. The lower end of each rod is welded to an L-shaped plate 193 which bears against a lower outside corner of the module. The bearing forces exerted by the L-shaped plates 193 are distributed over an extended area by a pair of identical short angle bars 194, 195 which also are welded to the L-shaped plates 193.

The upper ends of the bracing rods are similarly fixed to L-shaped plates 196 that bear against the upper corners of the modules through angle bars 197, 198.

The cross-braces are thus easy and quick to install and are held rigidly and strongly in place by a simple and inexpensive fastening arrangement that loads the edges of the concrete panels only in compression and distributes such compression loading over a safe area to obviate crushing the concrete edges. To withstand greater compression loads, poured concrete 199 suitably reinforced, can be added adjacent the sides and the upper portion of the modules as shown in FIG. 38.

By installing the cross braces adjacent to the ends of the modules, they can be incorporated into an end wall, and the X-configuration leaves ample space for windows as desired.

Because the cross braces are loaded only in tension, regardless of the direction of applied racking forces, relatively small diameter rods are required. In addition the rod size can be decreased for the upper story modules, which must withstand progressively smaller side loading forces.

From the foregoing detailed description of the disclosed method and preferred embodiments, it is clear that the present invention provides significant improvements over the modular building system of U.S. Pat. No. 3,990,193 referred to previously.

In particular, the ring-like rigid girder frames created by the assembly of floor slab and wall and roof panels of the present invention result in modules having thinner concrete panels and increased frame spacing, yet with greater rigidity and at approximately 50% of the construction cost of the previous modules.

The method of erecting modular building by "floating" the units on a thin mortar pressure distribution pad results in substantive construction economies, yet with improved building stability in sandy type soils. The poured concrete monolithic roof design and the cross-bracing feature for multiple story buildings contribute further to a unique modular building having improved strength, rigidity, and stability at reduced costs of construction.

What is claimed is:

1. A prefabricated building module in the form of a box comprising at least two opposing side wall portions, a ceiling portion and a floor portion, each of the two side wall portions and the ceiling portion including a thin layer of concrete-like material and a plurality of elongated metallic reinforcing members extending approximately vertically across one surface of the thin layer of each side wall portion in the manner of studs and extending across the one surface of the ceiling portion in the manner of joists, with one edge portion of each reinforcing member being embedded in the one surface and the other edge portion of each reinforcing member extending outwardly therefrom, and a means rigidly attaching the reinforcing members of each of the side wall portions to corresponding reinforcing members of the ceiling portion and to the floor portion for forming a rigid, box-like structure, wherein the improvement comprises:

a plurality of elongated metallic reinforcing members extending in spaced relation transversely of the floor portion in line with the respective lower ends of the side wall reinforcing members and the means for attaching the lower end portions of the reinforcing members of each of the side wall panels to the edges of the floor portion adjacent thereto comprise means for rigidly attaching each of said lower end portions to the end portion of the reinforcing member of the floor portion adjacent thereto.

2. A prefabricated building module according to claim 1 wherein each of the elongated metallic reinforcing members of the side wall portions, ceiling portion, and floor portion comprises straight bars defining the spaced edge portions of the reinforcing member and a bar bent into a zig-zag shape defining an open web portion of the reinforcing member, the longitudinal spacing of the zig-zag bends being greater in the central portion of the reinforcing member than in the opposite end portions.

3. A prefabricated building module according to claim 1 or 2 wherein the edge portions of each of the elongated metallic reinforcing members of the side wall portions, ceiling portion and floor portion comprise spaced apart straight bars, the means for rigidly attaching each reinforcing member of each of the side wall portions to a corresponding reinforcing member of the ceiling portion comprises a flat steel upper connecting plate, predetermined lengths of the upper ends of the straight bars of each side wall reinforcing member being lap welded to a face of the upper connecting plate, and predetermined lengths of the ends of the straight bars of the adjacent reinforcing member of the ceiling portion also being lap welded to a surface of the same upper connecting plate.

4. A prefabricated building module according to claim 3 wherein the means for rigidly attaching each of the lower end portions of the side wall reinforcing members to the end portion of the reinforcing member of the floor portion adjacent thereto comprises a flat steel lower connecting plate, predetermined lengths of the lower ends of the straight bars of each side wall reinforcing member being lap welded to a face of the lower connecting plate, and predetermined lengths of the ends of the straight bars of the adjacent reinforcing member of the floor portion also being lap welded to a surface of the same lower connecting plate, whereby the respective ceiling, wall, and floor reinforcing members are rigidly connected by a flat connecting plate at each junction to form a series of spaced rigid annular frames from adjacent one end of the box-like module to adjacent the other end of the module.

5. A prefabricated building module according to claim 4 wherein the reinforcing members of the ceiling portion and the reinforcing members of the floor portion comprise a clamp plate in the form of an open channel member located adjacent to each end of each reinforcing member, the channel member having a rectangular base and two sides extending at an angle from opposite edges thereof, the base of the channel member having two spaced openings conforming to the cross sections of the spaced straight bars of the respective reinforcing member, the channel member being positioned with the ends of the bars extending a predetermined distance through the holes in the base on the same side thereof as the sides of the channel, the base of the channel member being welded to the bars, and said predetermined distance being equal to the predetermined lengths of said bars that are lap welded to the respective connecting plate.

6. A prefabricated building module according to claim 5 wherein a vertical edge of each upper connecting plate is welded to the base of the adjacent clamp plate of the corresponding ceiling reinforcing member and a vertical edge of each lower connecting plate is welded to the base of the adjacent clamp plate of the corresponding floor reinforcing member.

7. A prefabricated building module according to claim 5 wherein the outer edges of the sides of each clamp plate are flush with the respective side edge of the corresponding concrete ceiling panel or floor slab.

8. A prefabricated building module according to claim 1 comprising a plurality of lightweight elongated rectangular boxes positioned in the corresponding spaces between adjacent ones of the spaced reinforcing members of the ceiling panel, the side edges of each box being spaced from the adjacent one of the reinforcing members, and a ribbed poured concrete roof slab on top said boxes, the ribs of said roof slab being formed by concrete filling the spaces between the side edges of adjacent boxes, and each rib being reinforced by a corresponding one of the ceiling panel reinforcing members.

9. A prefabricated building module according to claim 1 wherein the height of one of the side wall portions is greater than the other of the side wall portions, and the ceiling portion slopes downward from the top edge of the one side wall portion to the top edge of the other side wall portion.

10. A prefabricated building module according to claim 1 wherein the floor portion and the ceiling portion have the shape of a sector of an annulus.

11. A prefabricated building module according to claim 1 and further comprising cross braces connected to corners of the module which are disposed diagonally with respect to one another, the cross braces being disposed adjacent at least one end portion of the module, the cross braces being adapted to carry tension loads when the module is subjected to lateral forces.

12. A method of constructing a lightweight building module comprising:

(a) fabricating a plurality of open web side wall reinforcing members;

(b) fabricating a plurality of open web ceiling reinforcing members and floor reinforcing members;

(c) placing a predetermined number of the open web side wall reinforcing members in spaced parallel relation with the planes of the open webs vertical, on a flat pad inside an open side wall panel form, the opposite ends of each reinforcing member extending by predetermined amounts beyond opposite sides of the form corresponding to the bottom and top edges, respectively, of a side wall panel;

(d) pouring concrete onto the pad inside the form to a predetermined depth sufficient to encase one edge of each reinforcing member therein, with the remainder of each reinforcing member extending above the surface of the concrete, the concrete when hardened forming a panel of predetermined size and thickness and having the opposite ends of each reinforcing member extending a predetermined distance beyond respective edges thereof;

(e) repeating steps (c) and (d) to form an additional reinforced concrete side wall panel;

(f) placing an equal predetermined number of the open web ceiling reinforcing members in spaced parallel relation with the planes of the open webs vertical, on a flat pad inside an open ceiling panel form, the opposite ends of each reinforcing member extending by predetermined amounts beyond opposite sides of the form corresponding to the opposite side edges of a ceiling panel;

(g) repeating step (d) to form a reinforced concrete ceiling panel;

(h) placing an equal predetermined number of the open web floor reinforcing members in spaced parallel relation with the planes of the open webs vertical, on a flat pad inside an open floor slab form, the opposite ends of each reinforcing member extending by predetermined amounts beyond opposite sides of the form corresponding to the opposite side edges of a floor slab;

(i) pouring concrete inside the form to a predetermined height sufficient to encase at least a portion of the reinforcing members therein, the concrete when hardened forming a slab of predetermined size and thickness and having the opposite ends of each reinforcing member extending a predetermined distance beyond respective side edges thereof;

(j) positioning one of the side wall panels perpendicular to the plane of the floor panel, with the lower edge of the side wall panel adjacent to one side edge of the floor slab, and with the exposed lower end of each side wall reinforcing member in overlapping contact with the exposed end of the corresponding floor reinforcing member;

(k) lap welding the lower end of each side wall reinforcing member to the contiguous end of the corresponding floor reinforcing member to form a series of rigid moment joint connections;

(l) repeating steps (j) and (k) for rigidly connecting the other side wall panel to the other side of the floor slab;

(m) positioning the ceiling panel with the side edges adjacent to the top edges of the corresponding side wall panels and with the exposed upper end of each reinforcing member of each side wall panel in overlapping contact with an exposed end of the corresponding ceiling reinforcing member, and (n) lap welding the upper end of each side wall reinforcing member to the contiguous end of the corresponding ceiling reinforcing member, thereby forming a building module having a series of spaced rigid annular reinforcing frames extending from one end to the other end of the module, each frame comprising corresponding side wall, floor, and ceiling reinforcing members welded together at the ends thereof into rigid moment joint connections.

13. A method of constructing a lightweight building module according to claim 12 wherein the step of fabricating each side wall reinforcing member comprises:

positioning two straight bars in spaced parallel relation a predetermined distance apart, the length of each bar being equal to the distance between the bottom edge and top edge of the side wall panel at the intended location of the reinforcing member;

bending a third bar into an elongated zig-zag open web member, the lateral distance between adjacent bends being equal to the spacing between the two straight bars and the longitudinal spacing between adjacent bends being greater in the central portion of the open web member than at the ends thereof;

welding alternate ones of the bends of the open web member to one of the straight bars;

welding the alternate others of the bends of the open web member to the other of the straight bars;

placing a flat steel connecting plate in overlapping contact with predetermined lengths of the straight bars at each end thereof, each flat connecting plate extending a predetermined distance beyond the corresponding ends of the two straight bars; and lap welding the predetermined lengths of both straight bars to the respective flat connecting plate at each end of the two straight bars.

14. A method of constructing a lightweight building module according to claim 12 or 13 wherein the step of fabricating each ceiling reinforcing member and each floor reinforcing member comprises:

positioning two straight bars in spaced parallel relation a predetermined distance apart, the length of each bar being greater than the distance between one side edge and the opposite side edge of the corresponding ceiling panel or floor slab at the intended location of the reinforcing member;

bending a third bar into an elongated zig-zag open web member, the lateral distance between adjacent bends being equal to the spacing between the two straight bars and the longitudinal spacing between adjacent bends being greater in the central portion of the open web member than at the ends thereof;

welding alternate ones of the bends of the open web member to one of the straight bars; and welding the alternate others of the bends of the open web member to the other of the straight bars.

15. A method of constructing a lightweight building module according to claim 14 wherein the step of fabricating each ceiling reinforcing member and each floor reinforcing member further comprises:

sliding a clamp plate having a flat steel base, with two holes therethrough shaped and spaced to correspond to the cross sectional shape and spacing of the two straight bars of each reinforcing member, over the spaced ends of said bars until a predetermined length of each bar extends from the face of the clamp plate and welding each clamp plate to the corresponding two bars.

16. A method of constructing a lightweight building module according to claim 14 wherein the step of lap welding the lower end of each side wall member to the contiguous end of the corresponding floor reinforcing member comprises lap welding the exposed portion of the lower connecting plate of each side wall reinforcing member to the exposed portions of the adjacent ends of the two straight bars of the corresponding floor reinforcing member.

17. A method of constructing a lightweight building module according to any of claim 14 wherein the step of lap welding the upper end of each side wall reinforcing member to the contiguous end of the corresponding ceiling reinforcing member comprises lap welding the exposed portion of the upper connecting plate of each side wall reinforcing member to the exposed portions of the adjacent ends of the two straight bars of the corresponding ceiling reinforcement member.

18. A method of constructing a lightweight building module according to claim 12 and further comprising the step of connecting cross braces between corners of the module which are disposed diagonally with respect to one another, the cross braces being disposed adjacent at least one end portion of the module, the cross braces being adapted to carry tension loads when the module is subjected to lateral forces.

* * * * *